US011034042B2

(12) United States Patent
Qin et al.

(10) Patent No.: US 11,034,042 B2
(45) Date of Patent: Jun. 15, 2021

(54) DETECTION MECHANISM, CUTTING APPARATUS HAVING THE SAME AND DETECTION METHOD

(71) Applicant: SAFE-RUN MACHINERY (SUZHOU) CO., LTD., Kunshan (CN)

(72) Inventors: Hongwen Qin, Kunshan (CN); Guosong Li, Kunshan (CN)

(73) Assignee: Safe-Run Machinery (Suzhou) Co., Ltd., Kunshan (CN)

( * ) Notice: Subject to any disclaimer, the term of this patent is extended or adjusted under 35 U.S.C. 154(b) by 52 days.

(21) Appl. No.: 16/659,423

(22) Filed: Oct. 21, 2019

(65) Prior Publication Data

US 2020/0078975 A1 Mar. 12, 2020

Related U.S. Application Data

(63) Continuation of application No. PCT/CN2018/083650, filed on Apr. 19, 2018.

(51) Int. Cl.
*B26D 5/34* (2006.01)
*B26D 7/06* (2006.01)

(52) U.S. Cl.
CPC ..... *B26D 5/34* (2013.01); *B26D 7/06* (2013.01); *B26D 2210/00* (2013.01)

(58) Field of Classification Search
CPC ..... B26D 5/34; B26D 7/06; B26D 2210/00
See application file for complete search history.

(56) References Cited

U.S. PATENT DOCUMENTS 2,665,757 A * 1/1954 Stevens ..... B29D 30/46 83/210
3,688,625 A 9/1972 Thomas
6,913,058 B1 * 7/2005 Takagi ..... B29C 53/58 156/117

(Continued)

FOREIGN PATENT DOCUMENTS

CN 201440076 U 4/2010
CN 203486645 U 3/2014

(Continued)

OTHER PUBLICATIONS

International Search Report (including English translation) and Written Opinion issued in PCT/CN2018/083650, dated Jul. 19, 2018, 11 pages.

*Primary Examiner* — Dominic J Bologna
(74) *Attorney, Agent, or Firm* — Arch & Lake LLP

(57) ABSTRACT

Disclosed is a detection mechanism and a cutting apparatus having the same. The detection mechanism includes a main body fixedly mountable to a beam and being provided with a guide rail; a sliding assembly slidably arranged on the guide rail, where a bottom of the sliding assembly is provided with a first roller; a rotating assembly rotatably arranged on the sliding assembly, where a bottom of the rotating assembly is provided with a second roller, the rotating assembly is provided with a position restoration device configured to urge the rotating assembly toward an initial position, and the rotating assembly is rotatable to a first position by an end of a body ply and to a second position by a lapping joint of the body ply; and a position sensing assembly fixedly arranged on the sliding assembly and configured to identify position information of the rotating assembly.

20 Claims, 4 Drawing Sheets

(56) References Cited

U.S. PATENT DOCUMENTS

| | | | | |
|---|---|---|---|---|
| 7,052,008 | B2 * | 5/2006 | Mitsuya | B65H 3/5261 271/122 |
| 2004/0262020 | A1 * | 12/2004 | Arntson | B23B 39/18 173/32 |
| 2007/0047157 | A1 * | 3/2007 | Miyahara | B41J 29/393 360/324.11 |
| 2008/0149259 | A1 * | 6/2008 | Downing | B29D 30/3007 156/123 |

FOREIGN PATENT DOCUMENTS

| | | | |
|---|---|---|---|
| CN | 204957684 | U | 1/2016 |
| CN | 105387831 | A | 3/2016 |
| CN | 205090944 | U | 3/2016 |
| CN | 205552606 | U | 9/2016 |
| WO | 2018196672 | A1 | 11/2018 |

* cited by examiner

DETECTION MECHANISM, CUTTING APPARATUS HAVING THE SAME AND DETECTION METHOD

CROSS-REFERENCE TO RELATED APPLICATIONS

This application is based upon and claims benefit to Chinese Patent Application No. 201720460058.3 filed on Apr. 28, 2017, and International Application No. PCT/CN2018/083650 filed on Apr. 19, 2018, the entire contents of which are incorporated herein by reference.

TECHNICAL FIELD

The present disclosure relates to the technical field of automobile tire building machines, for example, relates to a detection mechanism for a body ply of an automobile tire, a cutting apparatus having the detection mechanism and a detection method.

BACKGROUND

Body ply is typically used as framework materials of tires and adhesive tape products, and have advantages of high strength, fatigue resistance, impact resistance, very low elongation, good thermal stability, good adhesion with rubber, aging resistance, ease of processing, etc. The body ply commonly used in rubber industry includes nylon body ply, polyester body ply, aramid body ply, steel-wire body ply, etc.

A body ply cutting apparatus is typically provided with a detection mechanism for determining a cutting position. However, the detection mechanism usually has low detection stability and poor adaptability, failing to accurately distinguish an end of the body ply material from a lapping joint of the body ply material, and seriously affecting cutting quality for the body ply as well as the accuracy of fixed-length cutting of the body ply.

SUMMARY

The present disclosure provides a detection mechanism, a cutting apparatus having the detection mechanism, and a detection method.

According to a first aspect of the present disclosure, there is provided a detection mechanism, including:

a main body, which is fixedly mountable to a beam above a feeding port of a material feeding plate, where the main body is provided with a guide rail, which is, in use, perpendicular to the material feeding plate where the main body is fixedly arranged onto the beam;

a sliding assembly, slidably arranged on the guide rail, where a bottom of the sliding assembly is provided with a first roller, the sliding assembly is operative to press the first roller onto the material feeding plate by a weight of the sliding assembly, and the first roller is operative to be caused to rotate about an axis of the first roller by a movement of a body ply on the material feeding plate;

a rotating assembly, rotatably arranged on the sliding assembly, where a bottom of the rotating assembly is provided with a second roller, the rotating assembly is provided with a position restoration device configured to urge the rotating assembly toward an initial position, and the second roller is operative to be caused to rotate about an axis of the second roller by movement of the body ply on the material feeding plate, where the rotating assembly is operative to be rotated to a first position by an end of the body ply, and is operative to be rotated to a second position by a lapping joint of the body ply; and a position sensing assembly, fixedly arranged on the sliding assembly and configured to identify position information of the initial position, the first position, and the second position of the rotating assembly and transmit the identified position information to a controller.

According to a second aspect of the present disclosure, there is provided a cutting apparatus, including a material feeding plate, a controller, and a detection mechanism, where the detection mechanism includes:

a main body, which is fixedly mountable to a beam above a feeding port of the material feeding plate, where the main body is provided with a guide rail, which is, in use, perpendicular to the material feeding plate where the main body is fixedly arranged on the beam;

a sliding assembly, slidably arranged on the guide rail, where a bottom of the sliding assembly is provided with a first roller, the sliding assembly is operative to press the first roller onto the material feeding plate by a weight of the sliding assembly, and the first roller is operative to be caused to rotate about an axis of the first roller by a movement of a body ply on the material feeding plate;

a rotating assembly, rotatably arranged on the sliding assembly, where a bottom of the rotating assembly is provided with a second roller, the rotating assembly is provided with a position restoration device configured to urge the rotating assembly toward an initial position, and the second roller is operative to be caused to rotate about an axis of the second roller by the movement of the body ply on the material feeding plate, where the rotating assembly is operative to be rotated to a first position by an end of the body ply, and is operative to be rotated to a second position by a lapping joint of the body ply; and a position sensing assembly, fixedly arranged on the sliding assembly and configured to identify position information of the initial position, the first position, and the second position of the rotating assembly and transmit the identified position information to a controller.

According to a third aspect of the present disclosure, there is provided a detection method, including:

providing a detection mechanism, where the detection mechanism includes:

a main body, which is fixedly mountable to a beam above a feeding port of a material feeding plate, where the main body is provided with a guide rail, which is, in use, perpendicular to the material feeding plate where the main body is fixedly arranged on the beam;

a sliding assembly, slidably arranged on the guide rail, where a bottom of the sliding assembly is provided with a first roller, the sliding assembly is operative to press the first roller onto the material feeding plate by a weight of the sliding assembly, and the first roller is operative to be caused to rotate about an axis of the first roller by a movement of a body ply on the material feeding plate;

a rotating assembly, rotatably arranged on the sliding assembly, where a bottom of the rotating assembly is provided with a second roller, the rotating assembly is provided with a position restoration device configured to urge the rotating assembly toward an initial position, and the second roller is operative to be caused to rotate about an axis of the second roller by the movement of the body ply on the material feeding plate, where the rotating assembly is operative to be rotated to a first position by an end of the body ply, and is operative to be rotated to a second position by a lapping joint of the body ply; and a position sensing assembly, fixedly arranged on the sliding assembly;

identifying, by the position sensing assembly, position information of the initial position, the first position, and the second position of the rotating assembly; and transmitting the identified position information to a controller.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure, in which.

DETAILED DESCRIPTION

Figure 1:
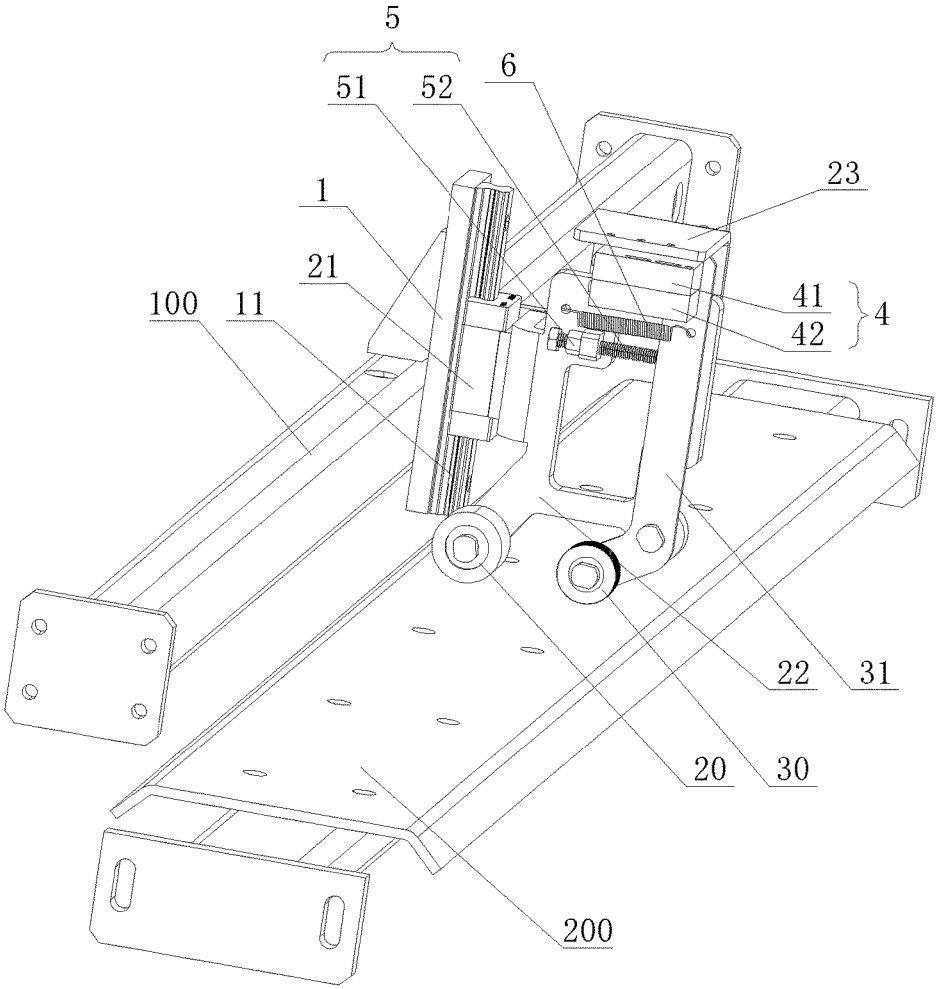
FIG. 1 is a schematic view of a detection mechanism mounted onto a beam according to an example of the present disclosure.

Reference is made in detail to aspects, examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the present disclosure. Instead, they are merely examples of devices and methods consistent with aspects related to the present disclosure.

The terminology used in the present disclosure is for the purpose of describing particular examples only and is not intended to limit the present disclosure. It should be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The words "above", "upper", "lower", "top", "bottom", etc. may be used to refer to relative positions of an element under normal operation mode or installation orientation, to facilitate understanding of the examples. The scope of the disclosure is not limited to the specific operation mode or installation orientation as described.

As illustrated in FIG. 1 to FIG. 5, a detection mechanism is provided according to examples of the present disclosure, which is applied to a body ply cutting apparatus. The detection mechanism includes a main body 1, a sliding assembly 2, a rotating assembly 3, and a position sensing assembly 4. The main body 1 is located above a material feeding plate 200 of the body ply cutting apparatus. The main body 1 in the example is fixedly arranged onto a beam 100 above a feeding port of the material feeding plate 200, which receives a body ply, or a body ply material, to be cut. That is, the main body 1 is fixedly mountable to the beam 100 above the feeding port. The main body 1 is provided with a guide rail 11, which is, in use, perpendicular to the material feeding plate 200. The sliding assembly 2 is slidably arranged on the guide rail 11. A bottom of the sliding assembly 2 is provided with a first roller 20. The sliding assembly 2 is operative to press the first roller 20 onto the material feeding plate 200 due to its own weight. The first roller 20 is operative to be caused to rotate about an axis of the first roller 20 by the movement of the body ply on the material feeding plate 200. The rotating assembly 3 is rotatably arranged on the sliding assembly 2. A bottom of the rotating assembly 3 is provided with a second roller 30. The rotating assembly 3 is provided with a position restoration device 6, which is configured to urge the rotating assembly 3 toward an initial position. That is, the position restoration device 6 drives the rotating assembly 3 to remain or maintain in the initial position when the rotating assembly 3 is not constrained, for example, by an end or a lapping joint of the body ply. The second roller 30 is operative to be caused to rotate about an axis of the second roller 30 by the movement of the body ply on the material feeding plate 200. In addition, when the body ply to be cut is moving along the material feeding plate 200, an end 300 of the body ply is capable of driving the rotating assembly 3 to a first position, and a lapping joint 400 (or a lap splice) of the body ply is operative to drive the rotating assembly 3 to a second position. The position sensing assembly 4 is fixedly arranged on the sliding assembly 2, and is configured to identify position information of the initial position, the first position, and the second position of the rotating assembly 3 and transmit the identified position information to a controller. The controller can perform fixed-length detection of the body ply and high-quality cutting that avoids the lapping joint 400 for the body ply on the material feeding plate 200 according to the received position information.

Figure 2:
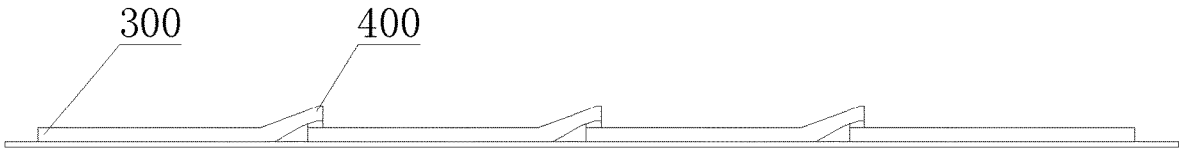
FIG. 2 is a schematic view of a body ply according to an example.
Figure 3:
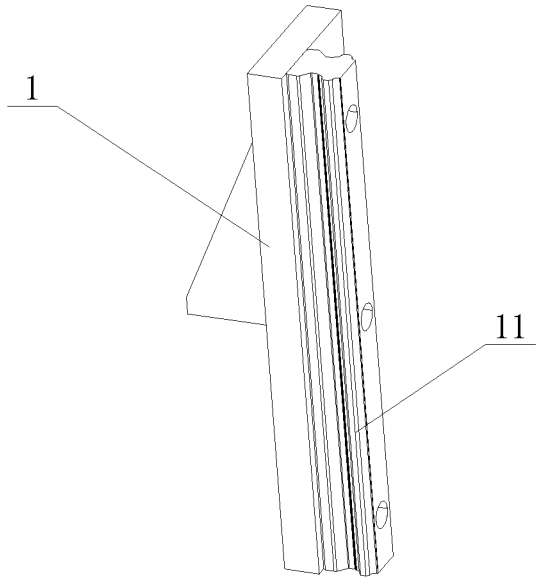
FIG. 3 is a schematic view of a main body of a detection mechanism according to an example.
Figure 4:
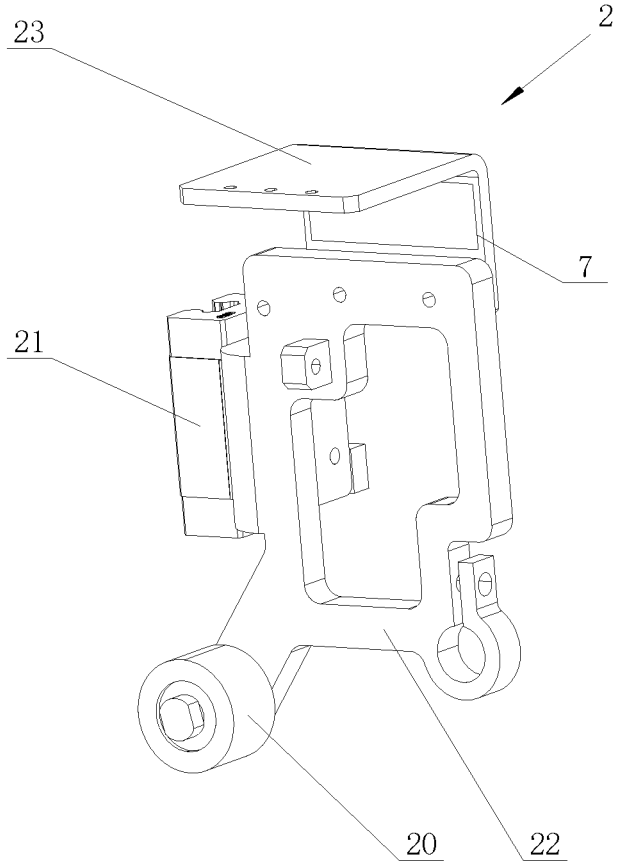
FIG. 4 is a schematic view of a sliding assembly according to an example.
Figure 5:
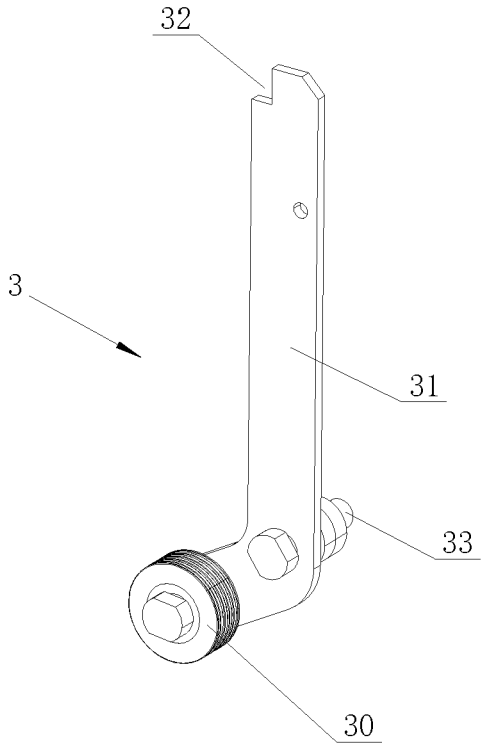
FIG. 5 is a schematic view of a rotating assembly according to an example.

When the detection mechanism according to the example is in use, along a feeding direction of the body ply (e.g., from right to left in FIG. 1), the end 300 of the body ply first contacts with the second roller 30 of the rotating assembly 3, and drives the rotating assembly 3 to rotate relative to the sliding assembly 2, so that the rotating assembly 3 deviates from the initial position and reaches the first position. The position sensing assembly 4 detects the position information of the rotating assembly 3 and transmits the position information to the controller. The body ply continues to move forward, and lifts the sliding assembly 2 along the guide rail 11 through the first roller 20, and the position restoration device 6 restores the unconstrained rotating assembly 3 to the initial position. The position sensing assembly 4 detects the position information of the rotating assembly 3 and transmits the position information to the controller. The body ply continues to move forward, and then the lapping joint 400 of the body ply contacts the second roller 30 of the rotating assembly 3 to drive the rotating assembly 3 to rotate relative to the sliding assembly 2. Since the height of the lapping joint 400 of the body ply is greater than that of the end 300 of the body ply (as illustrated in FIG. 2), the rotating assembly 3 deviates from the initial position and reaches the second position. The position sensing assembly 4 detects the position information of the rotating assembly 3 and transmits the position information to the controller. The body ply continues to move forward, and the lapping joint 400 of the body ply contacts the first roller 20 of the sliding assembly 2. The body ply lifts the sliding assembly 2 along the guide rail 11 through the first roller 20, and the position restoration device 6 restores the unconstrained rotating assembly 3 to the initial position. The position sensing assembly 4 detects the position information of the rotating assembly 3 and transmits the position information to the controller. Accordingly, the detection mechanism is able to accurately determine an end and a lapping joint of the body ply according to the position information of the rotating assembly 3.

The cooperating arrangement between the sliding assembly 2 and the rotating assembly 3 on the main body 1 is simple in structure, safe and reliable. In addition, through the position sensing assembly 4, accurate distinction between the end 300 and the lapping joint 400 of the body ply is achieved, thereby providing stable and reliable data information for fixed-length detection of the body ply and high-quality cutting that avoids the lapping joint 400.

Figure 6:
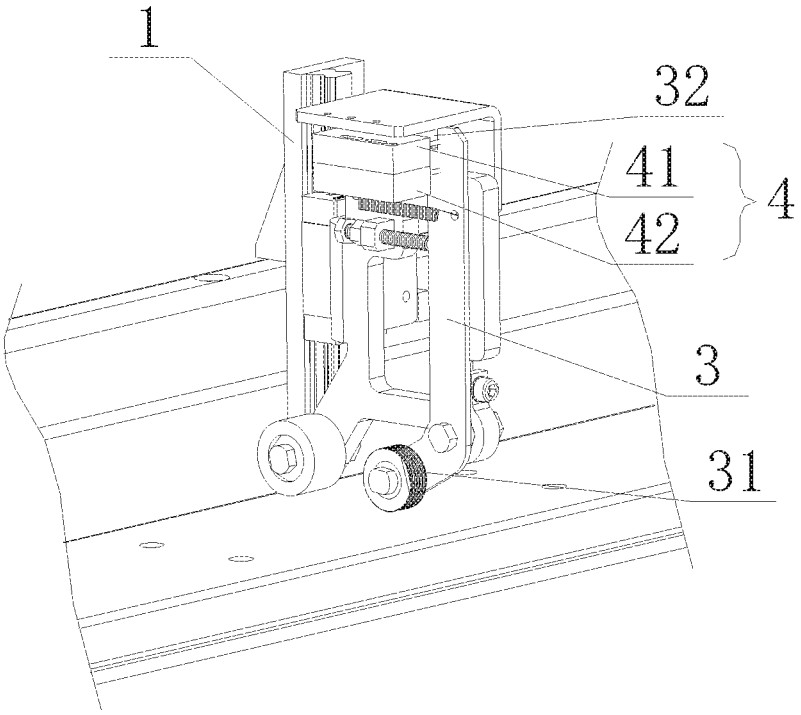
FIG. 6 is a partial schematic view illustrating a detection mechanism that is mounted onto a beam and that is in an initial position according to an example.
Figure 7:
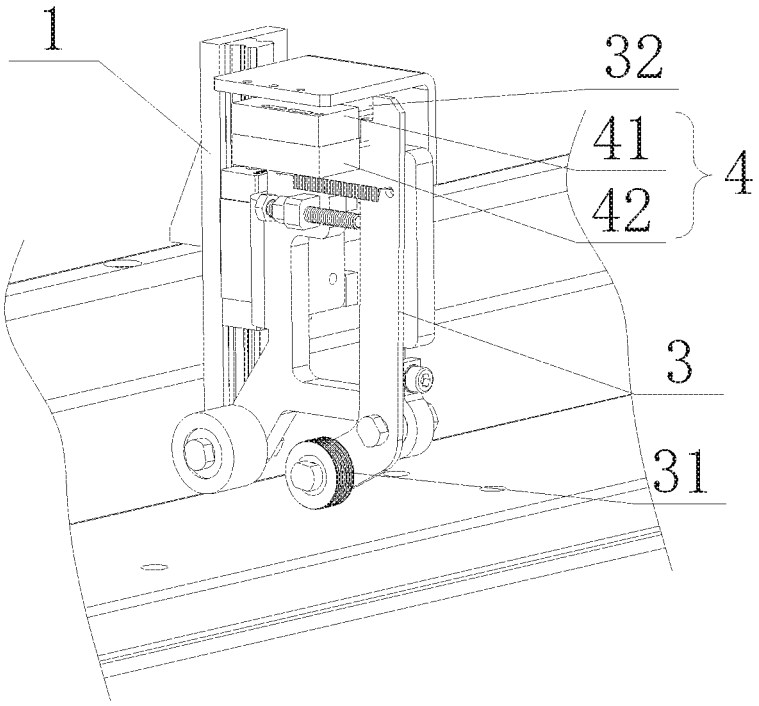
FIG. 7 is a partial schematic view of a detection mechanism that is mounted onto a beam and that is in a first position according to an example.
Figure 8:
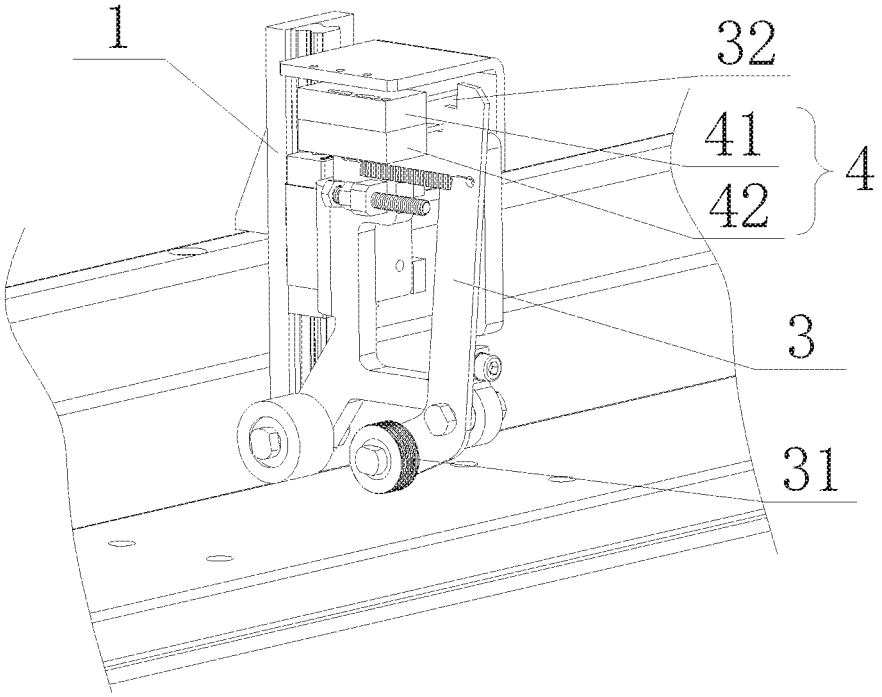
FIG. 8 is a partial schematic view of a detection mechanism that is mounted onto a beam and that is in a second position according to an example.

In the example, the position sensing assembly 4 includes a first photoelectric sensor 41 and a second photoelectric sensor 42 attached to a lower side of the first photoelectric sensor 41. In some examples, each of the photoelectric sensors 41, 42 may include a light emitting device for providing an optical signal. The optical signal may be reflected by some other parts. For example, a reflective part 7 may be provided on a side wall of the mounting plate 23, or on the rotating plate 31. Each of the photoelectric sensors 41, 42 may further include a light detecting device for detecting the optical signals reflected. When the rotating assembly 3 is in the initial position (referring to FIG. 6), the optical signals of the first photoelectric sensor 41 and the second photoelectric sensor 42 can be blocked by the rotating assembly 3 at the same time. When the rotating assembly 3 is in the first position (referring to FIG. 7), the optical signal of the first photoelectric sensor 4is not blocked by the rotating assembly 3, while the optical signal of the second photoelectric sensor 42 can be blocked by the rotating assembly 3. When the rotating assembly 3 is in the second position (referring to FIG. 8), the optical signal of the first photoelectric sensor 41 and the optical signal of the second photoelectric sensor 42 cannot be blocked by the rotating assembly 3. The cooperation of the first photoelectric sensor 41 and the second photoelectric sensor 42 directly and efficiently realizes the determination of the initial position, the first position and the second position of the rotating assembly 3 by the position sensing assembly 4, and accurately and reliably realizes the judgment of the end 300 and the lapping joint 400 of the body ply.

In an example, the sliding assembly 2 includes a sliding seat 21, a sliding frame 22, and an L-shaped mounting plate 23. The sliding seat 21 is slidably arranged on the guide rail 11 or slidably engaged with the guide rail 11. The sliding frame 22 is fixed to the sliding seat 21. The mounting plate 23 is fixedly mounted on an upper side of the sliding frame 22. The position sensing assembly 4 is fixedly mounted to a top wall of the mounting plate 23. For example, the sensing assembly 4 may be mounted to the top wall of the mounting plate 23 from below as shown in FIG. 1. The first roller 20 is disposed at a bottom of the sliding frame 22. Moreover, when the rotating assembly 3 is in the second position, the optical signals of the position sensing assembly 4 (i.e., the optical signals of the first photoelectric sensor 41 and the second photoelectric sensor 42) are projected onto a sidewall of the mounting plate 23. The above arrangement is simple and reliable in structure, and the processing and manufacturing cost is low, so that the detecting function of the detecting mechanism according to the example is more conveniently and efficiently realized.

In the example, the rotating assembly 3 includes a rotating plate 31, and the second roller 30 is disposed at a bottom of the rotating plate 31. The arrangement is simple in structure, high in stability during use, and convenient for maintenance and replacement.

In the example, the rotating plate 31 is provided with a notch 32 formed on a top end thereof. When the rotating assembly 3 is in the first position, the optical signal of the first photoelectric sensor 41 is projected onto the side wall of the mounting plate 23 through the notch 32. The arrangement is simple and reliable, and adaptable.

In the example, the side wall of the mounting plate 23 is provided with a reflective part 7. When the rotating assembly 3 is in the initial position, both the first photoelectric sensor 41 and the second photoelectric sensor 42 do not receive the optical signals. When the rotating assembly 3 is in the first position, the first photoelectric sensor 41 is operative to receive the optical signal reflected by the reflective part 7, and the second photoelectric sensor 42 does not receive the optical signal by the reflective part 7. When the rotating assembly 3 is in the second position, both the first photoelectric sensor 41 and the second photoelectric sensor 42 are operative to receive the optical signals reflected by the reflective part 7. The reflective part 7 may be a reflective paper, or other part capable of reflecting the optical signals of the photoelectric sensors, or the reflective part 7 may be provided by mirror-polishing the side wall of the mounting plate 23. The arrangement is safe, reliable, low-cost, durable and convenient to repair and replace.

In an example, the sliding assembly 2 is further provided with an adjustment assembly 5. The adjustment assembly 5 can adjust the initial position of the rotating assembly 3. The arrangement enables the initial position of the rotating assembly 3 to be adjustable, so that the detection mechanism according to the example may not only accurately detect the end 300 and the lapping joint 400 of the body ply, but also adjust the detection mechanism according to the actual size of the body ply. This enables the detection mechanism to be suitable for detecting the body plies having different thicknesses and detecting folding and stacking of the body ply, thus accurately determining the cutting position.

The adjustment assembly 5 according to the example includes an adjustment nut 51 fixed to the sliding assembly 2 and an adjustment bolt 52 matched with the adjustment nut 51. The rotating assembly 3 can be abutted against an end of the adjustment bolt 52 by the position restoration device 6. The initial position of the rotating assembly 3 can be adjusted by adjusting an amount of protrusion of the adjustment bolt 52 relative to the adjustment nut 51. The arrangement is simple and reliable in structure, and quick and convenient to adjust. Through the arrangement, the initial position of the rotating assembly 3 can be finely adjusted according to the use condition. The position restoration device 6 may be a spring or any other devices having a similar function. In addition, a first end of the position restoration device 6 is connected to the sliding frame 22, and a second end of the position restoration device 6 is connected to the rotating plate 31.

In the example, the rotating assembly 3 is arranged on the sliding assembly 2 through a rotating shaft 33, which acts as a pivot when the rotating assembly 3 rotates to the different positions. The arrangement is simple and reliable in structure, and the adjustment process of the arrangement is safe and convenient.

In some other examples, the reflective part 7 is arranged on the rotating plate 31, instead of the side wall of the mounting plate 23. At this time, when the rotating assembly 3 is in the initial position, both the first photoelectric sensor 41 and the second photoelectric sensor 42 are operative to receive the optical signals reflected by the reflective part 7. When the rotating assembly 3 is in the first position, the first photoelectric sensor 41 does not receive the optical signal, and the second photoelectric sensor 42 can receive the optical signal reflected by the reflective part 7. When the rotating assembly 3 is in the second position, neither the first photoelectric sensor 41 nor the second photoelectric sensor 42 receives the optical signals.

The reflective part 7 may be a reflective paper, or other part capable of reflecting the optical signals of the photoelectric sensors, or the reflective part 7 may be provided by mirror-polishing the rotating plate 31. The arrangement is safe, reliable, low-cost, durable and convenient to repair and replace.

A cutting apparatus for fixed-length cutting of the body ply is provided according to examples of the present disclosure. The cutting apparatus includes a material feeding plate, a controller, and the detection mechanism described above.

A detection method for determining an end or a lapping joint of a body play is provided according to examples of the present disclosure. The detection method includes providing the detection mechanism described above; identifying, by the position sensing assembly, position information of the initial position, the first position, and the second position of the rotating assembly; and transmitting the identified position information to a controller.

The detection mechanism according to the present disclosure may more accurately distinguish an end of body ply from a lapping joint of the body ply, thereby increasing cutting quality for the body ply as well as accuracy of fixed-length cutting of the body ply that are cut by the cutting apparatus.

Other examples of the disclosure are easily conceivable for those skilled in the art from consideration of the specification and with practice of the disclosure disclosed here. The disclosure is intended to cover any variations, usages or adaptations of the disclosure which conform to the general principles thereof and includes common general knowledge and conventional technical means in the technical field not disclosed in the disclosure. The specification and the examples are only considered as exemplary.

It should be understood that the disclosure is not limited to the exact construction described above and illustrated in the accompanying drawings, and various modifications and changes can be made without departing from the scope thereof.

What is claimed is:

1. A detection mechanism, comprising:

a main body, which is fixedly mountable to a beam above a feeding port of a material feeding plate, wherein the main body is provided with a guide rail, which is, in use, perpendicular to the material feeding plate where the main body is fixedly arranged on the beam;

a sliding assembly, slidably arranged on the guide rail, wherein a bottom of the sliding assembly is provided with a first roller, the sliding assembly is operative to press the first roller onto the material feeding plate by a weight of the sliding assembly, and the first roller is operative to be caused to rotate about an axis of the first roller by a movement of a body ply on the material feeding plate;

a rotating assembly, rotatably arranged on the sliding assembly, wherein a bottom of the rotating assembly is provided with a second roller, the rotating assembly is provided with a position restoration device configured to urge the rotating assembly toward an initial position, and the second roller is operative to be caused to rotate about an axis of the second roller by the movement of the body ply on the material feeding plate, wherein the rotating assembly is operative to be rotated to a first position by an end of the body ply, and is operative to be rotated to a second position by a lapping joint of the body ply; and a position sensing assembly, fixedly arranged on the sliding assembly and configured to identify position information of the initial position, the first position, and the second position of the rotating assembly and transmit the identified position information to a controller.

2. The detection mechanism of claim 1, wherein the position sensing assembly comprises a first photoelectric sensor and a second photoelectric sensor attached to a lower side of the first photoelectric sensor;

when the rotating assembly is in the initial position, the rotating assembly simultaneously blocks optical signals of the first photoelectric sensor and the second photoelectric sensor;

when the rotating assembly is in the first position, the rotating assembly does not block the optical signal of the first photoelectric sensor, and blocks the optical signal of the second photoelectric sensor; and when the rotating assembly is in the second position, the rotating assembly does not block the optical signal of the first photoelectric sensor or the optical signal of the second photoelectric sensor.

3. The detection mechanism of claim 2, wherein the sliding assembly comprises a sliding seat, a sliding frame, and an L-shaped mounting plate, wherein the sliding seat is slidably arranged on the guide rail, the sliding frame is fixed to the sliding seat, the mounting plate is fixedly mounted on an upper side of the sliding frame, the position sensing assembly is fixedly mounted to a top wall of the mounting plate, the first roller is disposed on a bottom of the sliding frame, and when the rotating assembly is in the second position, the optical signals of the position sensing assembly are projected onto a side wall of the mounting plate.

4. The detection mechanism of claim 3, wherein the rotating assembly comprises a rotating plate, and the second roller is disposed at a bottom of the rotating plate.

5. The detection mechanism of claim 4, wherein a top of the rotating plate is provided with a notch, and when the rotating assembly is in the first position, the optical signal of the first photoelectric sensor is projected onto the side wall of the mounting plate through the notch.

6. The detection mechanism of claim 5, wherein the side wall of the mounting plate is provided with a reflective part;

when the rotating assembly is in the initial position, both the first photoelectric sensor and the second photoelectric sensor do not receive the optical signals;

when the rotating assembly is in the first position, the first photoelectric sensor is operative to receive the optical signal reflected by the reflective part, and the second photoelectric sensor does not receive the optical signal; and when the rotating assembly is in the second position, both the first photoelectric sensor and the second photoelectric sensor are operative to receive the optical signals reflected by the reflective part.

7. The detection mechanism of claim 5, wherein the rotating plate is provided with a reflective part;

when the rotating assembly is in the initial position, both the first photoelectric sensor and the second photoelectric sensor are operative to receive the optical signals reflected by the reflective part;

when the rotating assembly is in the first position, the first photoelectric sensor does not receive the optical signal, and the second photoelectric sensor is operative to receive the optical signal reflected by the reflective part; and when the rotating assembly is in the second position, both the first photoelectric sensor and the second photoelectric sensor do not receive the optical signals.

8. The detection mechanism of claim 4, wherein a first end of the position restoration device is connected to the the sliding frame, and a second end of the position restoration device is connected to the rotating plate.

9. The detection mechanism of claim 8, wherein the position restoration device is a spring.

10. The detection mechanism of claim 1, wherein the sliding assembly is further provided with an adjustment assembly, which is operative to adjust the initial position of the rotating assembly.

11. The detection mechanism of claim 10, wherein the adjustment assembly comprises an adjustment nut fixed to the sliding assembly and an adjustment bolt matched with the adjustment nut, the rotating assembly is operative to abut against an end of the adjustment bolt through the position restoration device, and the initial position of the rotating assembly is adjustable by adjusting an amount of protrusion of the adjustment bolt relative to the adjustment nut.

12. The detection mechanism of claim 1, wherein the rotating assembly is arranged on the sliding assembly through a rotating shaft.

13. A cutting apparatus, comprising a material feeding plate, a controller, and a detection mechanism, wherein the detection mechanism comprises:

a main body, which is fixedly mountable to a beam above a feeding port of the material feeding plate, wherein the main body is provided with a guide rail, which is, in use, perpendicular to the material feeding plate where the main body is fixedly arranged on the beam;

a sliding assembly, slidably arranged on the guide rail, wherein a bottom of the sliding assembly is provided with a first roller, the sliding assembly is operative to press the first roller onto the material feeding plate by a weight of the sliding assembly, and the first roller is operative to be caused to rotate about an axis of the first roller by a movement of a body ply on the material feeding plate;

a rotating assembly, rotatably arranged on the sliding assembly, wherein a bottom of the rotating assembly is provided with a second roller, the rotating assembly is provided with a position restoration device configured to urge the rotating assembly toward an initial position, and the second roller is operative to be caused to rotate about an axis of the second roller by the movement of the body ply on the material feeding plate, wherein the rotating assembly is operative to be rotated to a first position by an end of the body ply, and is operative to be rotated to a second position by a lapping joint of the body ply; and a position sensing assembly, fixedly arranged on the sliding assembly and configured to identify position information of the initial position, the first position, and the second position of the rotating assembly and transmit the identified position information to a controller.

14. The cutting apparatus of claim 13, wherein the position sensing assembly comprises a first photoelectric sensor and a second photoelectric sensor attached to a lower side of the first photoelectric sensor;

when the rotating assembly is in the initial position, the rotating assembly simultaneously blocks optical signals of the first photoelectric sensor and the second photoelectric sensor;

when the rotating assembly is in the first position, the rotating assembly does not block the optical signal of the first photoelectric sensor, and blocks the optical signal of the second photoelectric sensor; and when the rotating assembly is in the second position, the rotating assembly does not block the optical signal of the first photoelectric sensor or the optical signal of the second photoelectric sensor.

15. The cutting apparatus of claim 14, wherein the sliding assembly comprises a sliding seat, a sliding frame, and an L-shaped mounting plate, wherein the sliding seat is slidably arranged on the guide rail, the sliding frame is fixed to the sliding seat, the mounting plate is fixedly mounted on an upper side of the sliding frame, the position sensing assembly is fixedly mounted to a top wall of the mounting plate, the first roller is disposed on a bottom of the sliding frame, and when the rotating assembly is in the second position, the optical signals of the position sensing assembly are projected onto a side wall of the mounting plate.

16. The cutting apparatus of claim 15, wherein the rotating assembly comprises a rotating plate, and the second roller is disposed at a bottom of the rotating plate.

17. The cutting apparatus of claim 16, wherein a top of the rotating plate is provided with a notch, and when the rotating assembly is in the first position, the optical signal of the first photoelectric sensor is projected onto the side wall of the mounting plate through the notch.

18. The cutting apparatus of claim 17, wherein the side wall of the mounting plate is provided with a reflective part;

when the rotating assembly is in the initial position, both the first photoelectric sensor and the second photoelectric sensor do not receive the optical signals;

when the rotating assembly is in the first position, the first photoelectric sensor is operative to receive the optical signal reflected by the reflective part, and the second photoelectric sensor does not receive the optical signal; and when the rotating assembly is in the second position, both the first photoelectric sensor and the second photoelectric sensor are operative to receive the optical signals reflected by the reflective part.

19. The cutting apparatus of claim 17, wherein the rotating plate is provided with a reflective part;

when the rotating assembly is in the initial position, both the first photoelectric sensor and the second photoelectric sensor are operative to receive the optical signals reflected by the reflective part;

when the rotating assembly is in the first position, the first photoelectric sensor does not receive the optical signal, and the second photoelectric sensor is operative to receive the optical signal reflected by the reflective part; and when the rotating assembly is in the second position, both the first photoelectric sensor and the second photoelectric sensor do not receive the optical signals.

20. A detection method, comprising:

providing a detection mechanism, wherein the detection mechanism comprises:

a main body, which is fixedly mountable to a beam above a feeding port of a material feeding plate, wherein the main body is provided with a guide rail, which is, in use, perpendicular to the material feeding plate where the main body is fixedly arranged on the beam;

a sliding assembly, slidably arranged on the guide rail, wherein a bottom of the sliding assembly is provided with a first roller, the sliding assembly is operative to press the first roller onto the material feeding plate by a weight of the sliding assembly, and the first roller is operative to be caused to rotate about an axis of the first roller by a movement of a body ply on the material feeding plate;

a rotating assembly, rotatably arranged on the sliding assembly, wherein a bottom of the rotating assembly is provided with a second roller, the rotating assembly is provided with a position restoration device configured to urge the rotating assembly toward an initial position, and the second roller is operative to be caused to rotate about an axis of the second roller by the movement of the body ply on the material feeding plate, wherein the rotating assembly is operative to be rotated to a first position by an end of the body ply, and is operative to be rotated to a second position by a lapping joint of the body ply; and a position sensing assembly, fixedly arranged on the sliding assembly;

identifying, by the position sensing assembly, position information of the initial position, the first position, and the second position of the rotating assembly; and transmitting the identified position information to a controller.

* * * * *